US010876706B2

(12) United States Patent
Beausoleil

(10) Patent No.: US 10,876,706 B2
(45) Date of Patent: Dec. 29, 2020

(54) LANDSCAPE LIGHTING SYSTEMS HAVING LED LAMPS THAT ENABLE INSTALLERS TO RAPIDLY IDENTIFY LUMEN LEVELS AND BEAM SPREADS

(71) Applicant: Mind Head LLC, Ridgewood, NJ (US)

(72) Inventor: David M. Beausoleil, Ridgewood, NJ (US)

(73) Assignee: Mind Head LLC, Ridgewood, NJ (US)

( * ) Notice: Subject to any disclaimer, the term of this patent is extended or adjusted under 35 U.S.C. 154(b) by 0 days.

(21) Appl. No.: 16/830,513

(22) Filed: Mar. 26, 2020

(65) Prior Publication Data

US 2020/0309343 A1 Oct. 1, 2020

Related U.S. Application Data

(60) Provisional application No. 62/824,174, filed on Mar. 26, 2019.

(51) Int. Cl.

| | |
|---|---|
| ***F21V 3/04*** | (2018.01) |
| ***F21L 14/02*** | (2006.01) |
| ***F21W 131/109*** | (2006.01) |
| ***F21Y 115/10*** | (2016.01) |
| ***F21Y 113/13*** | (2016.01) |

(52) U.S. Cl.

CPC ..... *F21V 3/04* (2013.01); *F21L 14/023* (2013.01); *F21W 2131/109* (2013.01); *F21Y 2113/13* (2016.08); *F21Y 2115/10* (2016.08)

(58) Field of Classification Search

CPC ..... F21V 3/04; F21V 3/049; F21S 8/08; F21S 8/081; F21S 8/083; F21Y 2113/10; F21Y 2113/13; F21Y 2115/10; F21L 14/023; F21W 2131/109

See application file for complete search history.

(56) References Cited

U.S. PATENT DOCUMENTS

| | | | | |
|---|---|---|---|---|
| 10,292,233 | B1 * | 5/2019 | Udavant | F21S 8/026 |
| 2011/0279015 | A1 * | 11/2011 | Negley | F21K 9/233 313/501 |
| 2012/0002417 | A1 * | 1/2012 | Li | F21V 17/007 362/249.02 |
| 2012/0038280 | A1 * | 2/2012 | Zoorob | H05B 45/22 315/151 |
| 2013/0114242 | A1 * | 5/2013 | Pickard | F21V 7/30 362/84 |
| 2017/0163439 | A1 * | 6/2017 | Bosua | H04B 10/1149 |
| 2019/0268981 | A1 * | 8/2019 | Diep | H05B 45/20 |

* cited by examiner

*Primary Examiner* — Alan B Cariaso

(74) *Attorney, Agent, or Firm* — Doherty IP Law Group LLC

(57) ABSTRACT

A landscape lighting system includes a first LED lamp including a first lamp body and an optic having at least one LED for generating light, and a second LED lamp including a second lamp body and an optic having at least one LED for generating light. The first lamp body has a first color for indicating a first lumen level for the light generated by the first LED lamp, and the second lamp body has a second color that is different than the first color for indicating a second lumen level for the light generated by the second LED lamp. The second lumen level is different than the first lumen level. The optics of the first and second LED lamps have transparent covers with beam angle spread indicators provided on the respective transparent covers. At least one of the optics has a color temperature indicator on a transparent cover.

17 Claims, 17 Drawing Sheets

100A

| Lamp Code | Beam from Fixture | | Halogen Equiv. | Lamp Body Color Code | Voltage Input | Color Temp. CCT/ CRI | Amps | Power Factor | Volt Amp (to size Trans.) | Factory Lumen | Lumen Output Enclosed Fixture | Rated Hrs. |
|---|---|---|---|---|---|---|---|---|---|---|---|---|
| SLMR161XXW27 | XX-Wide | 80º | 10 Watt | RED 1 Watt | 10-24 VAC | 2700ºK/ 83 CRI | 0.139 | 0.63 | 1.69 | 240 | 74 | 50,000 |
| SLMR161XW27 | X-Wide | 55º | | | | | 0.139 | 0.63 | 1.69 | | 106 | |
| SLMR161W27 | Wide | 40º | | | | | 0.139 | 0.63 | 1.69 | | 104 | |

100B

| Lamp Code | Beam from Fixture | | Halogen Equiv. | Lamp Body Color Code | Voltage Input | Color Temp. CCT/ CRI | Amps | Power Factor | Volt Amp (to size Trans.) | Factory Lumen | Lumen Output Enclosed Fixture | Rated Hrs. |
|---|---|---|---|---|---|---|---|---|---|---|---|---|
| SLMR162XXW27 | XX-Wide | 80º | 20 Watt | GREEN 2 Watt | 10-24 VAC | 2700ºK/ 83 CRI | 0.236 | 0.664 | 2.83 | 300 | 128 | 50,000 |
| SLMR162XW27 | X-Wide | 55º | | | | | 0.236 | 0.664 | 2.83 | | 183 | |
| **SLMR162W27** | **Wide** | **40º** | | | | | 0.236 | 0.664 | 2.83 | | 189 | |
| SLMR162M27 | Medium | 30º | | | | | 0.236 | 0.664 | 2.83 | | 193 | |
| **SLMR162N27** | **Narrow** | **20º** | | | | | 0.236 | 0.664 | 2.83 | | 167 | |

100C

| Lamp Code | Beam from Fixture | | Halogen Equiv. | Lamp Body Color Code | Voltage Input | Color Temp. CCT/ CRI | Amps | Power Factor | Volt Amp (to size Trans.) | Factory Lumen | Lumen Output Enclosed Fixture | Rated Hrs. |
|---|---|---|---|---|---|---|---|---|---|---|---|---|
| SLMR164XXW27 | XX-Wide | 80º | 35 Watt | BLUE 4 Watt | 10-24 VAC | 2700ºK/ 83 CRI | 0.387 | 0.691 | 4.67 | 390 | 199 | 50,000 |
| SLMR164XW27 | X-Wide | 55º | | | | | 0.387 | 0.691 | 4.67 | | 299 | |
| SLMR164W27 | Wide | 40º | | | | | 0.387 | 0.691 | 4.67 | | 304 | |
| SLMR164M27 | Medium | 30º | | | | | 0.387 | 0.691 | 4.67 | | 305 | |
| SLMR164N27 | Narrow | 20º | | | | | 0.387 | 0.691 | 4.67 | | 267 | |

FIG. 4

100E

| Lamp Code | Beam from Fixture | | Halogen Equiv. | Lamp Body Color Code | Voltage Input | Color Temp. CCT/ CRI | Amps | Power Factor | Volt Amp (to size Trans.) | Factory Lumen | Lumen Output Enclosed Fixture | Rated Hrs. |
|---|---|---|---|---|---|---|---|---|---|---|---|---|
| SLMR165XXW27 | XX-Wide | 80º | 50 Watt | BLACK 5 Watt | 10-24 VAC | 2700ºK/ 83 CRI | 0.542 | 0.7 | 6.56 | 540 | 175 | 50,000 |
| SLMR165XW27 | X-Wide | 55º | | | | | 0.542 | 0.7 | 6.56 | | 392 | |
| SLMR165W27 | Wide | 40º | | | | | 0.542 | 0.7 | 6.56 | | 419 | |
| **SLMR165M27** | **Medium** | **30º** | | | | | 0.542 | 0.7 | 6.56 | | 421 | |
| SLMR165N27 | Narrow | 20º | | | | | 0.542 | 0.7 | 6.56 | | 381 | |

FIG. 5

| Lamp Code | Beam from Fixture | | Halogen Equiv. | Lamp Body Color Code | Volt-age Input | Color Temp. CCT/ CRI | Amps | Power Factor | Volt Amp (to size Trans.) | Factory Lumen | Lumen Output Enclosed Fixture | Rated Hrs. |
|---|---|---|---|---|---|---|---|---|---|---|---|---|
| SLMR166XXW27 | XX-Wide | 80º | 75 Watt | **WHITE 6 Watt** | 10-24 VAC | 2700ºK/ 83 CRI | 0.706 | 0.717 | 8.49 | 720 | 213 | 50,000 |
| SLMR166XW27 | X-Wide | 55º | | | | | 0.706 | 0.717 | 8.49 | | 440 | |
| SLMR166W27 | Wide | 40º | | | | | 0.706 | 0.717 | 8.49 | | 527 | |
| **SLMR166M27** | **Medium** | **30º** | | | | | 0.706 | 0.717 | 8.49 | | 575 | |
| **SLMR166N27** | **Narrow** | **20º** | | | | | 0.706 | 0.717 | 8.49 | | 559 | |

LANDSCAPE LIGHTING SYSTEMS HAVING LED LAMPS THAT ENABLE INSTALLERS TO RAPIDLY IDENTIFY LUMEN LEVELS AND BEAM SPREADS

CROSS-REFERENCE TO RELATED APPLICATIONS

The present patent application claims benefit of U.S. Provisional Application Ser. No. 62/824,174, filed on Mar. 26, 2019, the disclosure of which is hereby incorporated by reference herein.

BACKGROUND OF THE INVENTION

Field of the Invention

The present patent application is generally related to lighting, and is more specifically related to landscape lighting systems.

Description of the Related Art

Decorative landscape lighting, when using the common "UP and "Down" lighting techniques, involves the use of different lumen levels and beam spread light sources on different height and width plant materials, architectural details and objects in order to apply the correct light levels that are required when designing a lighting scene. If a designer uses only one brightness level and beam spread light source for all of the small, narrow, wide, and/or tall elements in the landscape, the design would be too bright or too dark and lack any dimension, depth, scale, and detail and essentially become washed out and/or a harsh scene for the human eye to observe at night among the neighboring backdrop of darkness.

Typically, a designer increases the lumen level and beam spreads as they get deeper into the landscape design from the viewing point of a patio or a sitting area and as the scale of the scene increases. Designers want the brightest part of a lighting design to be located at the back and the lowest lighting level to be located in the foreground, which enables the eye to move throughout the lighting scene. In order to direct people around and through a property, allow the human eye to transition through the illuminated scenery, and create focal points in the landscape lighting, designers typically employ different light levels, which requires different beam spreads for the differently sized material that is being illuminated.

Lighting designers typically "build" their lighting designs by starting with lower light levels and wider beam spreads and then gradually increasing the light levels by 30-40% with each subsequent layer of lighting as they get deeper into the depth of the landscape design and property of plant material, scenery and objects and as the plants become larger and wider and the scene evolves, and the light gradually increases in brightness. Additionally, higher light levels are used to create focal or anchor points in a lighting design (e.g., bird baths, statues, gazebos, waterfalls, architecture, fountains, things of interest, etc.), which typically involves using even higher light levels than anything in the surrounding scene in order to draw an observer's eye to the object.

A lighting designer will typically spend a great deal of time identifying a beam spread and lumen value lamp light sources that will then be used to build these lighting scenes. By choosing the most appropriate light levels and beam spreads that work with the item being illuminated, the designer composes a lighting design. The challenge for the designer is that the landscape lights are typically fixed and deliver a given beam spread and lumen level, which cannot be tuned or adjusted in the field to modify brightness levels and/or beam spread. Should the designer want a lower or higher lumen value, or a wider or narrower beam spread, the designer must replace the lamp that is inserted inside the light fixture housing, which involves physically removing the lens/shroud of the lighting fixture. The process of switching lamps to select the right lumen and beam angle becomes confusing if all of the lamps that are used are the same color and there is no differentiating feature or visual indicator on the lamps that allows the installer/designer to quickly and accurately identify the lumen level and/or beam spread of the lamp.

Typically most lamps identify the beam/wattage and lumen by using micro-printed marking that is located at the base of the lamp. A widely used light source in landscape lighting design is a LED version of the popular legacy tungsten halogen MR16 light source that was invented in the 1960's. The designation MR refers to "Mirror Reflected," and the designation 16 refers to the diameter across the face of the lamp, which is measured in ⅛ths of an inch. For example, the measurement across the face of an MR16 light source is about two (2) inches in diameter.

With the advent of the Light Emitting Diode (LED), lamp manufacturers have essentially mimicked as best they can the beam spread and the lumen value of the legacy Tungsten Halogen MR16 lamps, which are configured for insertion into the footprint of the legacy halogen lamp dimensions so that existing light fixtures could accept the new LED technology and the consumer could upgrade existing systems to the new LED technology.

To date, the lamp bodies of all LED MR16 light sources come in one standard color, such as white, blue or black for every combination of lumen values and beam spreads because manufacturers prefer to order only one MR16 lamp body in order to increase volume and decrease cost of manufacturing.

If, during an installation project, a designer wishes to identify a lumen value and/or a beam spread of a lamp that has been installed in a light fixture, the designer is required to remove the lamp and read the laser etched or printed markings that are located at the base of the lamp, which may or may not indicate the beam spread and the lumen value of the lamp.

Most lamp manufacturers produce a variety of lamps having different beam angles such as Narrow (10-20 degrees), Medium (20-30 degrees), Wide (30-40 degrees), X-Wide (40-60 degrees), and XX-Wide (60 to 120 degrees). In addition, lamp manufacturers published brightness values of the bare lamp and the bare lamps beam spread. The above-noted information that manufacturers provide fails to accurately account for the actual performance of the lamp once it has been inserted into a light fixture, in particular the actual beam spread and the lumen value when the lamp is installed inside an actual lighting fixture.

In view of the above-noted deficiencies, there remains a need for landscape lighting systems that enable lighting designers and installers to quickly, accurately and easily identify lamp lumen values and beam spreads and be able to obtain both information for the bare lumen data and beam data for the lamp and the lumen and beam data for the lamp while in actual operation in a light fixture. In addition, remains a need for improved systems that enable a lighting designer and/or installer to quickly identify the wattage and the associated corresponding lumen value range of a lamp depending on the beam spread without having to read the fine print located at the base of the lamp.

SUMMARY OF THE INVENTION

In one embodiment of the present patent application, each lumen value range or light level range of a specific beam angle of a first lamp, such as 70-110 lumen lamp depending on the beam spread, may be identified by a color such as RED and identified as light level #1, or as a 1 wattage LED. Additionally, the lamp may also be referred as having a light output that is akin to that achieved when using a legacy halogen 10 Watt MR16 lamp.

In one embodiment, a second lamp with a next higher level of lumens, which is typically 30% or better than the prior level (i.e., the first lamp) depending on the beam spread with a lumen value of between 128 to 193 may be identified by a color such as GREEN and identified as light level #2, or as a 2 wattage LED. Additionally, the lamp may also be referred as having a light output that is akin to that achieved when using a legacy halogen 20 Watt MR16 lamp.

In one embodiment, a third lamp with the next higher level of lumens, which is typically 30% or better than the prior level (i.e., the second lamp) depending on the beam spread with a lumen value of between 199 to 305 may be identified by a color such as BLUE and identified as light level #3, or as a 4 wattage LED. Additionally, the lamp may also be referred as having a light output that is akin to that achieved when using a legacy halogen 35 Watt MR16 lamp.

In one embodiment, a fourth lamp with the next higher level of lumens, which is typically 30% or better than the prior level (i.e., the third lamp) depending on the beam spread with a lumen value of between to 175 to 421 may be identified by a color such as BLACK and identified as light level #4, or as a 5 wattage LED. Additionally, the lamp may also be referred as having a light output that is akin to that achieved when using a legacy halogen50 Watt MR16 lamp.

In still another embodiment, a fifth lamp with the next higher level of lumens, which is typically 30% or better than the prior level (i.e., a fourth lamp) depending on the beam spread with a lumen value of between to 213 to 575 may be identified by a color such as WHITE and identified as light level #5, or as a 6 wattage LED. Additionally, the lamp may also be referred as having a light output that is akin to that achieved when using a legacy halogen 75 Watt MR16 lamp.

In one embodiment, each lamp may have a specific color assigned thereto. The unique color preferably enables an installer to quickly identify the lumen range of each lamp, which may also depend upon the beam spread of the lamp.

In one embodiment, the one or more markings on the optic of the lamp may be visible when looking at the lamp through the lens of the light fixture in which the lamp is installed. In one embodiment, the specific beam spread may be printed or laser etched on the face of the lamp and is visible, thus being easily identified by a landscape lighting installer. In one embodiment, the beam angle spreads may include N for narrow (e.g., 20 degrees), M for medium (e.g., 30 degrees), W for wide (e.g., 40 degrees), X-W for extra wide (e.g., 55 degrees), and XX-W for extra, extra wide (e.g., 80 degrees). In one embodiment, the reference beam angles for lamps may also be laser etched on the face of the lamp and visible to the installer.

In one embodiment, preferred markings on the optics may be Narrow (e.g., a light beam angle spread of 10-20 degrees), Medium (e.g., a light beam angle spread of 20-30 degrees), Wide (e.g., a light beam angle spread of 30-40 degrees), X-Wide (e.g., a light beam angle spread of 40-60 degrees), and XX-Wide (e.g., a light beam angle spread of 60-120 degrees). This face or top identification of the LED lamp, in addition to the molding of the letters N, M, W, X-W, XX-W in the plastic of the LED optic, may also be stamped, laser etched, molded in the plastic of the optic on the face of the lamp, or indicated by using numbers such as 1, 2, 3, 4, 5, which may be easily identified by an installer once the color of the lamp body is seen (e.g., at the top of the lamp), which in most cases would not require an installer to remove the lamp from the light fixture, thus saving the installer's time when attempting to identify the exact specifications for the lamp that is in use.

In one embodiment, in addition to providing the beam angle on the face of the lamp optic, additional information such as the Correlated Color Temperature (CCT) of the LED may also be identified. Typically, warm white correlates to 2700K, whereby the abbreviation 27K may be provided (e.g., laser etched) on the front optic. In other embodiment, the abbreviations for the color temperatures may be 30K for 3000K, 40K for 4000K, 50K for 5000K, etc. The objective of the color coding of the lamp body, the laser etching of the beam angle, and the identification of the color temperature is to create a fast and easy way for contractors, installers, and end users to organize landscape lighting lamps before, during and after installation to insure accuracy with design and product application.

In one embodiment, a landscape lighting system preferably includes a first LED lamp including a first lamp body and an optic having at least one LED for generating light, and a second LED lamp including a second lamp body and an optic having at least one LED for generating light.

In one embodiment, the first lamp body desirably has a first color for indicating a first lumen level for the light generated by the first LED lamp, and the second lamp body desirably has a second color that is different than the first color for indicating a second lumen level for the light generated by the second LED lamp. In one embodiment, the second lumen level (e.g., a second lumen range) is different than the first lumen level (e.g., a second lumen range).

In one embodiment, the optic of the first LED lamp has a transparent cover with a beam angle spread indicator provided on the transparent cover for indicating a beam angle spread for the light emitted from the first LED lamp.

In one embodiment, the optic of the second LED lamp has a transparent cover with a beam angle spread indicator provided on the transparent cover for indicating a beam angle spread for the light emitted from the second LED lamp.

In one embodiment, at least one of the optics preferably includes a transparent cover and a color temperature indicator provided on the transparent cover.

In one embodiment, the system may include a third LED lamp with a third lamp body and an optic having at least one LED for generating light. In one embodiment, the third lamp body desirably has a third color that is different than the first and second colors for indicating a third lumen level for the light generated by the third LED lamp, whereby the third lumen level is different than the first and second lumen levels.

In one embodiment, the system may include a fourth LED lamp with a fourth lamp body and an optic having at least one LED for generating light, the fourth lamp body having a fourth color that is different than the first, second, and third colors for indicating a fourth lumen level for the light generated by the fourth LED lamp. In one embodiment, the fourth lumen level is different than the first, second, and third lumen levels.

In one embodiment, the system may include a fifth LED lamp including a fifth lamp body and an optic having at least one LED for generating light, the fifth lamp body having a fifth color that is different than the first, second, third, and fourth colors for indicating a fifth lumen level for the light generated by the fifth LED lamp. In one embodiment, the fifth lumen level is different than the first, second, third, and fourth lumen levels.

In one embodiment, the first lamp body is red, the second lamp body is green, the third lamp body is blue, the fourth lamp body is black, and the fifth lamp body is white.

In one embodiment, a landscape lighting system preferably includes a first LED lamp having a first lamp body and an optic having at least one LED for generating light, the first lamp body having a first color for indicating a first lumen level for the light generated by the first LED lamp, and a second LED lamp including a second lamp body and an optic having at least one LED for generating light, the second lamp body having a second color for indicating a second lumen level for the light generated by the second LED lamp.

In one embodiment, the system includes a third LED lamp having a third lamp body and an optic having at least one LED for generating light, the third lamp body having a third color for indicating a third lumen level for the light generated by the third LED lamp, a fourth LED lamp including a fourth lamp body and an optic having at least one LED for generating light, the fourth lamp body having a fourth color for indicating a fourth lumen level for the light generated by the fourth LED lamp, and a fifth LED lamp including a fifth lamp body and an optic having at least one LED for generating light, the fifth lamp body having a fifth color for indicating a fifth lumen level for the light generated by the fifth LED lamp.

In one embodiment, the respective first, second, third, fourth and fifth colors of the lamp bodies are different from one another. In one embodiment, the different colors may include red, green, blue, black, and white.

In one embodiment, the respective first, second, third, fourth and fifth lumen levels have lumen level ranges that are different from one another.

In one embodiment, the first lumen level has a lumen level range of about 74-106 lumens, the second lumen level has a lumen level range of about 128-193 lumens, the third lumen level has a lumen level range of about 199-305 lumens, the fourth lumen level has a lumen level range of about 175-421 lumens, and the fifth lumen level has a lumen level range of about 213-575 lumens.

In one embodiment, at least of the optics of the LED lamps has a transparent cover and a beam angle spread indicator provided on the transparent cover.

In one embodiment, at least one of the optics of the LED lamps has a transparent cover and a color temperature indicator provided on the transparent cover.

In one embodiment, the system may include a kit having at least two of the first LED lamps, at least two of the second LED lamps, at least two of the third LED lamps, at least two of the fourth LED lamps, and at least two of the fifth LED lamps.

In one embodiment, a landscape lighting system desirably includes a first LED lamp having a first lamp body with a first color for indicating a first lumen level for light generated by the first LED lamp and an optic having at least one LED for generating the light that is emitted from the first LED lamp. In one embodiment, the optic of the first LED lamp preferably has a transparent cover with a beam angle spread indicator provided on the transparent cover for indicating a beam angle spread for the light that is emitted from the first LED lamp.

In one embodiment, the landscape lighting system preferably includes a second LED lamp having a second lamp body with a second color that is different than the first color for indicating a second lumen level for light generated by the second LED lamp and an optic having at least one LED for generating the light that is emitted from the second LED lamp. In one embodiment, the optic of the second LED lamp has a transparent cover with a beam angle spread indicator provided on the transparent cover for indicating a beam angle spread for the light that is emitted from the second LED lamp, whereby the second lumen level of the light that is emitted from the second LED lamp is different than the first lumen level of the light that is emitted from the first LED lamp.

In one embodiment, at least one optic of the LED lamps has a transparent cover and a color temperature indicator provided on the transparent cover.

BRIEF DESCRIPTION OF THE DRAWINGS

FIG. 4 is a specification chart for a third LED lamp of the landscape lighting system shown in FIG. 1, in accordance with one embodiment of the present patent application.

FIG. 5 is a specification chart for a fourth LED lamp of the landscape lighting system shown in FIG. 1, in accordance with one embodiment of the present patent application.

DETAILED DESCRIPTION OF PREFERRED EMBODIMENTS

Figure 1:
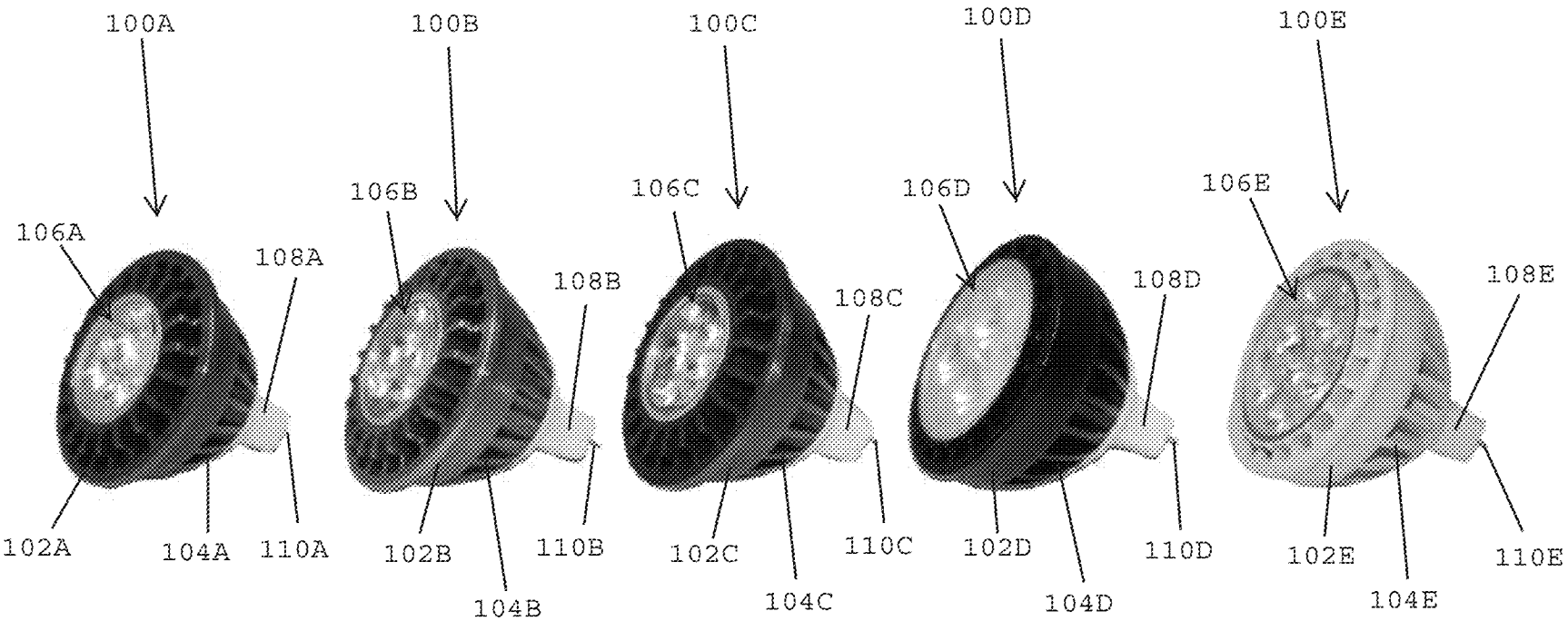
FIG. 1 is a landscape lighting system including a plurality of LED lamps having lamp bodies that indicate different lumen levels and optics that indicate different beam spread angles, in accordance with one embodiment of the present patent application.

Referring to FIG. 1, in one embodiment, a landscape lighting system preferably includes a plurality of LED lamps 100A-100E. In one embodiment, the LED lamps 100A-100E may be inserted into landscape lighting fixtures, such as legacy halogen MR16 light fixtures. In one embodiment, each of the LED lamps 100A-100E may be designed to generate light having different lumen levels and/or different light beam angle spreads. In one embodiment, each the LED lamps 100A-100E may have unique external markings and/or visual indicia that enable landscape lighting installers to easily identify the particular lumen level for the light and/or the light beam angle spread of each LED lamp, without requiring installers to physically remove the LED lamp from a light fixture.

Figure 2:
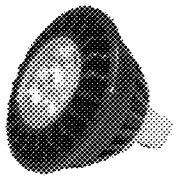
FIG. 2 is a specification chart for a first LED lamp of the landscape lighting system shown in FIG. 1, in accordance with one embodiment of the present patent application.

Referring to FIGS. 1 and 2, in one embodiment, the system preferably includes a first LED lamp 100A having a first lamp body 102A with heat dissipating fins 104A, a first optic 106A that contains one or more LEDs that generate light that is emitted from the first LED lamp 100A, a driver housing 108A that contains an LED driver and/or electronics, and electrical contact pins 110A for connecting the first LED lamp 100A to a source of electrical power (e.g., 10-24 VAC). In one embodiment, the first lamp body 102A preferably has a unique color assigned thereto (e.g., the color RED), which provides a readily discernible visual indicator to installers that the first LED lamp 100A generates light at a first lumen level, which may also be referred to as light level #1. In one embodiment, the first lumen level of the light may be within a range of about 74-106 lumens. The particular lumen level of the light emitted by the first LED lamp 100A may vary depending upon the beam angle spread of the first optic 106A. In one embodiment, the first LED lamp 100A may be identified as a 1 wattage LED. In another embodiment, the first LED lamp 100A may be referred as having a light output that is similar to a legacy halogen 10 Watt MR16 lamp.

In one embodiment, the first optic 106A may transmit the light at a beam angle spread of about 40-80 degrees. In one embodiment, the beam angle spreads may be distinct beam angle spreads of 40 degrees (i.e., Wide), 55 degrees (i.e., X-Wide), and 80 degrees (XX-Wide). In one embodiment, the beam angle spread of the first optic 106A may be etched or printed on the clear or transparent cover of the first optic 106A so that installers may easily determine the beam angle spread of the first LED lamp 100A by looking at the clear or transparent cover.

Figure 3:
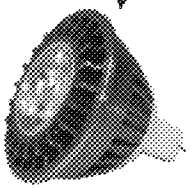
FIG. 3 is a specification chart for a second LED lamp of the landscape lighting system shown in FIG. 1, in accordance with one embodiment of the present patent application.

Referring to FIGS. 1 and 3, in one embodiment, the system preferably includes a second LED lamp 100B having a second lamp body 102B with heat dissipating fins 104B, a second optic 106B that contains one or more LEDs that generate light that is emitted from the second LED lamp 100B, a driver housing 108B that contains an LED driver and/or electronics, and electrical contact pins 110B for connecting the second LED lamp 100B to a source of electrical power (e.g., 10-24 VAC). In one embodiment, the second lamp body 102B preferably has preferably has a unique color assigned thereto (e.g., the color GREEN), which provides a readily discernible visual indicator to installers that the second LED lamp 100B generates light at a second lumen level that is different than the first lumen level of the first LED lamp 100A. The second lumen level of the second LED lamp 100A may also be referred to as light level #2. In one embodiment, the second lumen level of the light may be within a range of about 128-193 lumens. The particular lumen level of the light emitted by the second LED lamp 100B may vary depending upon the beam angle spread of the second optic 106B. In one embodiment, the second LED lamp 100B may be identified as a 2 wattage LED. In another embodiment, the second LED lamp 100B may be referred as having a light output that is similar to a legacy halogen 20 Watt MR16 lamp.

In one embodiment, the second optic 106B may transmit the light at a beam angle spread of about 20-80 degrees. In one embodiment, the beam angle spreads may be distinct beam angle spreads of 20 degrees (i.e., Narrow), 30 degrees (i.e., Medium), 40 degrees (i.e., Wide), 55 degrees (i.e., X-Wide), and 80 degrees (XX-Wide). In one embodiment, the beam angle spread of the second optic 106B may be etched or printed on the clear or transparent cover of the second optic 106B so that installers may easily determine the beam angle spread of the second LED lamp 100B by simply looking at the clear or transparent cover.

Referring to FIGS. 1 and 4, in one embodiment, the system preferably includes a third LED lamp 100C having a third lamp body 102C with heat dissipating fins 104C, a third optic 106C that contains one or more LEDs that generate light that is emitted from the third LED lamp 100C, a driver housing 108C that contains an LED driver and/or electronics, and electrical contact pins 1100 for connecting the third LED lamp 100C to a source of electrical power (e.g., 10-24 VAC). In one embodiment, the third lamp body 1020 preferably has a unique color assigned thereto (e.g., the color BLUE), which provides a readily discernible visual indicator to installers that the third LED lamp 100C generates light at a third lumen level that is different than the first lumen level of the first LED lamp 100A and the second lumen level of the second LED lamp 100B. In one embodiment, the third lumen level may also be referred to as light level #3. In one embodiment, the third lumen level of the light may be within a range of about 267-305 lumens. The particular lumen level of the light emitted by the third LED lamp 100C may vary depending upon the beam angle spread of the third optic 1060. In one embodiment, the third LED lamp 100C may be identified as a 4 wattage LED. In another embodiment, the third LED lamp 1000 may be referred as having a light output that is similar to a legacy halogen 35 Watt MR16 lamp.

In one embodiment, the third optic 106C may transmit the light at a beam angle spread of about 20-80 degrees. In one embodiment, the beam angle spreads may be distinct beam angle spreads of 20 degrees (i.e., Narrow), 30 degrees (i.e., Medium), 40 degrees (i.e., Wide), 55 degrees (i.e., X-Wide), and 80 degrees (XX-Wide). In one embodiment, the beam angle spread of the third optic 106C may be etched or printed on the clear or transparent cover of the third optic 106C so that installers may easily determine the beam angle spread of the third LED lamp 100C by simply looking at the clear or transparent cover.

Referring to FIGS. 1 and 5, in one embodiment, the system preferably includes a fourth LED lamp 100D having a fourth lamp body 102D with heat dissipating fins 104D, a fourth optic 106D that contains one or more LEDs that generate light that is emitted from the fourth LED lamp 100D, a driver housing 108D that contains an LED driver and/or electronics, and electrical contact pins 110D for connecting the fourth LED lamp 100D to a source of electrical power (e.g., 10-24 VAC). In one embodiment, the fourth lamp body 102D preferably has a unique color assigned thereto (e.g., the color BLACK), which provides a readily discernible visual indicator to installers that the fourth LED lamp 100D generates light at a fourth lumen level that is different than the first lumen level of the first LED lamp 100A, the second lumen level of the second LED lamp 100B, and the third lumen level of the third LED lamp 100C. In one embodiment, the third lumen level may also be referred to as light level #4. In one embodiment, the fourth lumen level of the light may be within a range of about 175421 lumens. The particular lumen level of the light emitted by the fourth LED lamp 100D may vary depending upon the beam angle spread of the fourth optic 106D. In one embodiment, the fourth LED lamp 100D may be identified as a 5 wattage LED. In another embodiment, the fourth LED lamp 100D may be referred as having a light output that is similar to a legacy halogen 50 Watt MR16 lamp.

In one embodiment, the fourth optic 106D may transmit the light at a beam angle spread of about 20-80 degrees. In one embodiment, the beam angle spreads may be distinct beam angle spreads of 20 degrees (i.e., Narrow), 30 degrees (i.e., Medium), 40 degrees (i.e., Wide), 55 degrees (i.e., X-Wide), and 80 degrees (XX-Wide), In one embodiment, the beam angle spread of the fourth optic 106D may be etched or printed on the clear or transparent cover of the fourth optic 106D so that installers may easily determine the beam angle spread of the fourth LED lamp 100D by simply looking at the clear or transparent cover.

Figure 6:
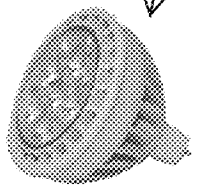
FIG. 6 is a specification chart for a fifth LED lamp of the landscape lighting system shown in FIG. 1, in accordance with one embodiment of the present patent application.

Referring to FIGS. 1 and 6, in one embodiment, the system preferably includes a fifth LED lamp 100E having a fifth lamp body 102E with heat dissipating fins 104E, a fifth optic 106E that contains one or more LEDs that generate light that is emitted from the fifth LED lamp 100E, a driver housing 108E that contains an LED driver and/or electronics, and electrical contact pins 110E for connecting the fifth LED lamp 100D to a source of electrical power (e.g., 10-24 VAC). In one embodiment, the fifth lamp body 102E preferably has a unique color assigned thereto (e.g., the color WHITE), which provides a readily discernible visual indicator to installers that the fifth LED lamp 100E generates light at a fifth lumen level that is different than the first lumen level of the first LED lamp 100A, the second lumen level of the second LED lamp 100B, the third lumen level of the third LED lamp 1000, and the fourth lumen level of the fourth LED lamp 100D. In one embodiment, the fifth lumen level may also be referred to as light level #5. In one embodiment, the fifth lumen level of the light may be within a range of about 213-575 lumens. The particular lumen level of the light emitted by the fifth LED lamp 100E may vary depending upon the beam angle spread of the fifth optic 106E. In one embodiment, the fifth LED lamp 100E may be identified as a 6 wattage LED. In another embodiment, the fifth LED lamp 100E may be referred as having a light output that is similar to a legacy halogen 75 Watt MR16 lamp.

In one embodiment, the fifth optic 106E may transmit the light at a beam angle spread of about 20-80 degrees. In one embodiment, the beam angle spreads may be distinct beam angle spreads of 20 degrees (i.e., Narrow), 30 degrees (i.e., Medium), 40 degrees (i.e., Wide), 55 degrees (i.e., X-Wide), and 80 degrees (XX-Wide). In one embodiment, the beam angle spread of the fifth optic 106E may be etched or printed on the clear or transparent cover of the fifth optic 106E so that installers may easily determine the beam angle spread of the fifth LED lamp 100E by simply looking at the clear or transparent cover.

Figure 7A:
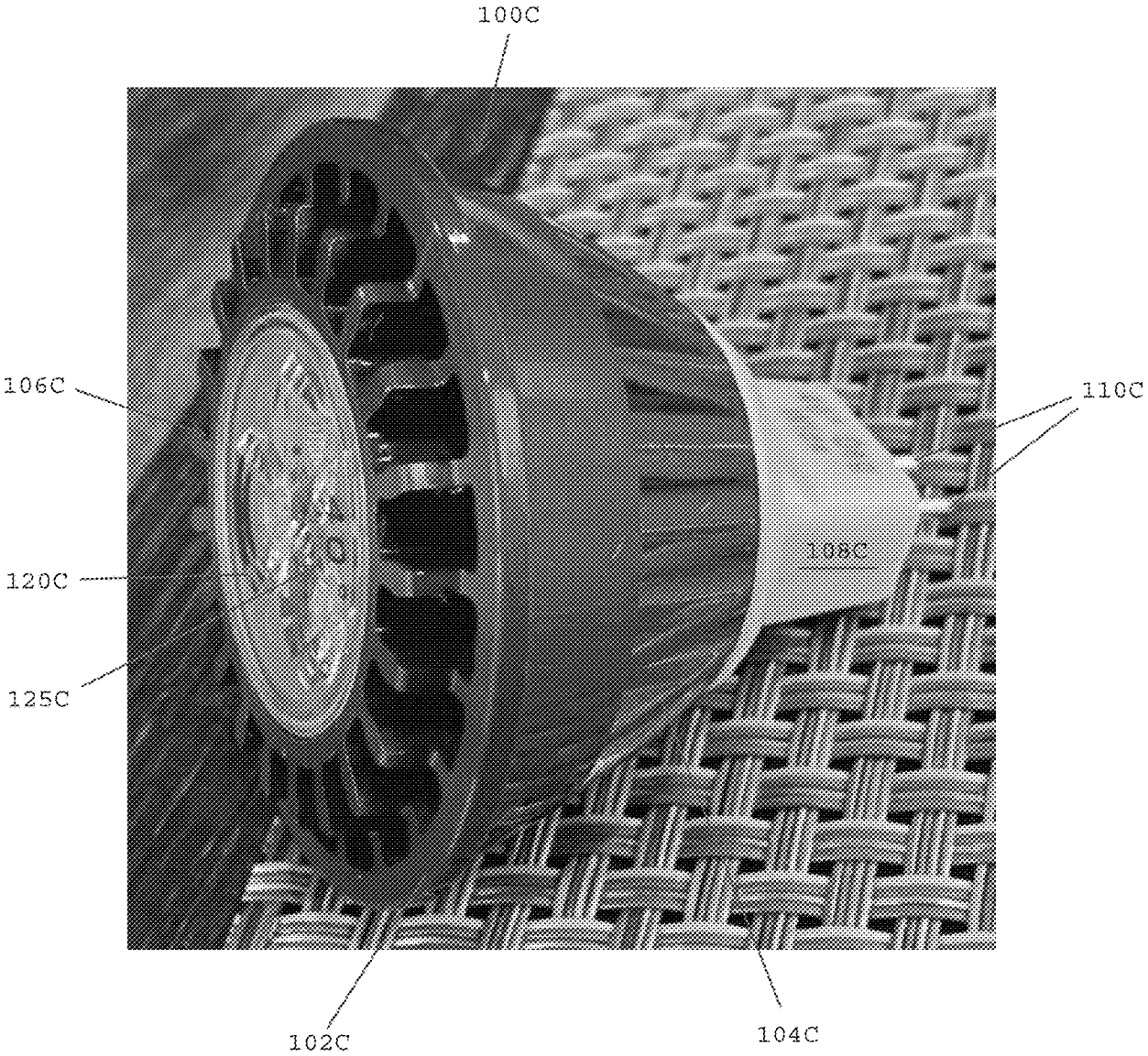
FIG. 7A is a perspective view of a side of a third LED lamp of the landscape lighting system shown in FIGS. 1 and 4, the third LED lamp including a lamp body, an optic, a driver housing, and electrical contact pins, in accordance with one embodiment of the present patent application.
Figure 7B:
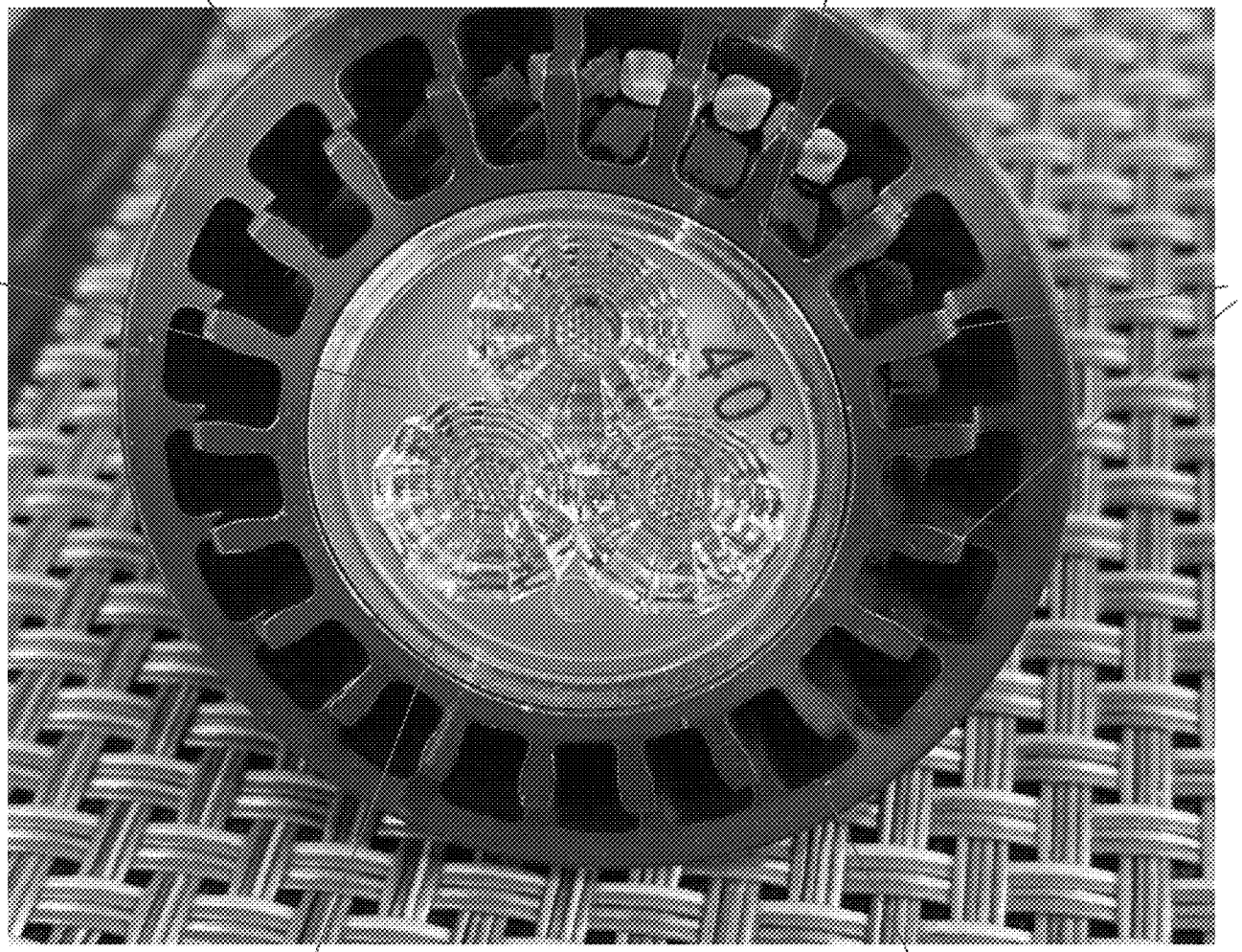
FIG. 7B is a perspective view of a top of the third LED lamp of the landscape lighting system shown in FIG. 7A.

Referring to FIGS. 7A and 7B, in one embodiment, the third LED lamp 100C preferably has the third lamp body 102C with heat dissipating fins 104C, the third optic 106C that contains one or more LEDs (e.g., three LEDs) that generate light that is emitted from the third LED lamp 100C, the driver housing 108C that contains an LED driver and/or electronics, and the electrical contact pins 110C for connecting the third LED lamp 100C to a source of electrical power (e.g., 10-24 VAC). In one embodiment, the third lamp body 102C preferably has a unique color assigned thereto (e.g., the color BLUE), which provides a readily discernible visual indicator to installers that the third LED lamp 100C generates light at the third lumen level, which is different from the lumen levels generated by the other LED lamps of the system. In one embodiment, the third lumen level may be referred to as light level #3, and may be within a range of about 267-305 lumens. The particular lumen level of the light emitted by the third LED lamp 100C may vary depending upon the beam angle spread of the third optic 106C.

In one embodiment, the third optic 106C preferably has a clear or transparent cover 1200 having a beam angle spread indicator 1250 that is etched or printed on the cover of the third optic 106C so that installers may easily determine the beam angle spread of the third LED lamp 100C by simply looking at the clear or transparent cover 120C. In the particular embodiment shown in FIGS. 7A and 7B, the beam angle spread 125C (e.g., 40 degrees) is printed or etched on the clear or transparent cover 120C to provide a readily discernible indicator of the beam angle spread of the light that is emitted from the third optic 106C.

Figure 8:
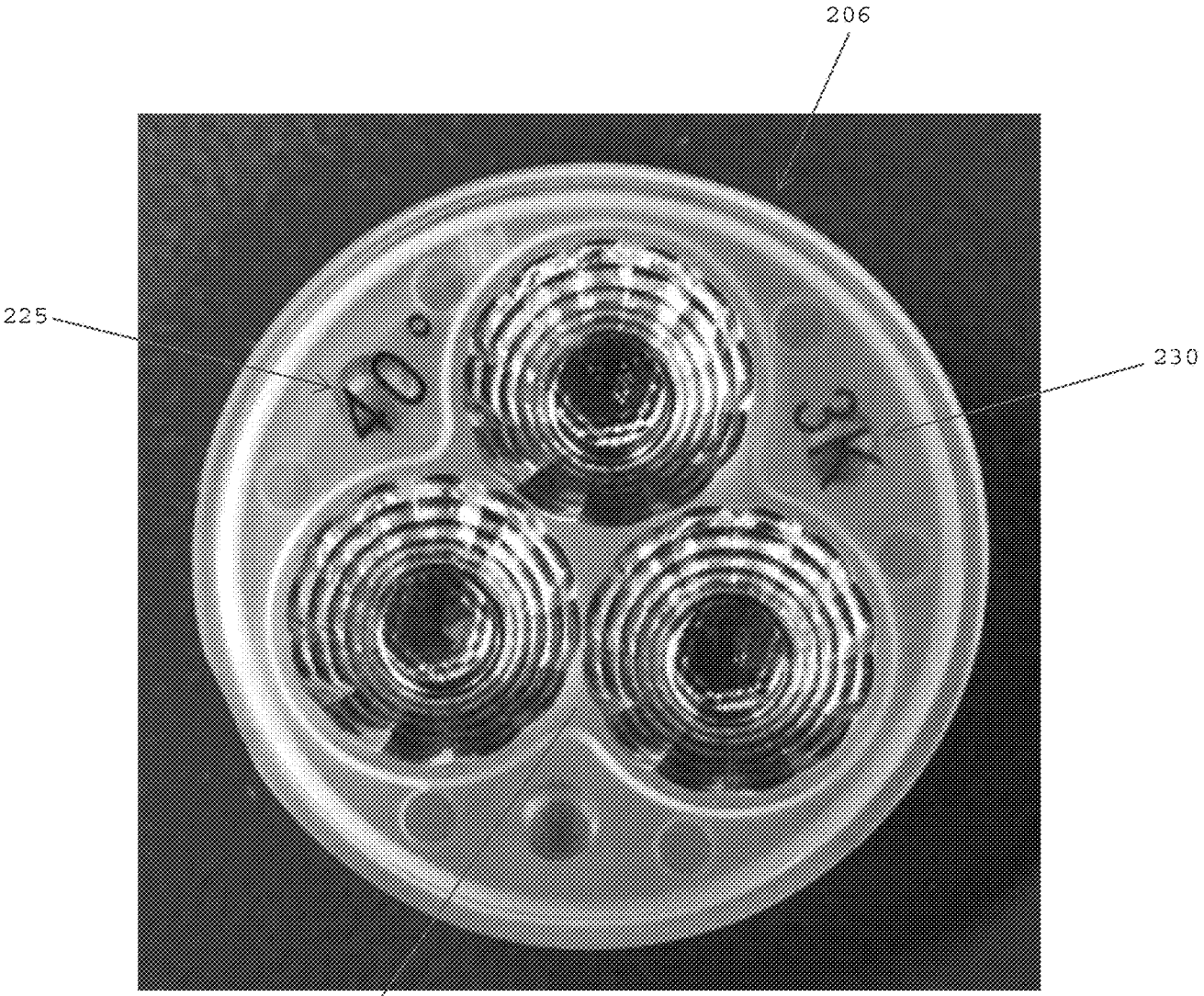
FIG. 8 is a top plan view of an optic of an LED lamp, in accordance with one embodiment of the present patent application.

Referring to FIG. 8, in one embodiment, an optic 206 for an LED lamp preferably has a clear or transparent cover 220 having a beam angle spread indicator 225 that is etched or printed on the cover of the optic 206 so that installers may easily determine the beam angle spread of an LED lamp by simply looking at the clear or transparent cover 220. In the particular embodiment shown in FIG. 8, the beam angle spread 225 is 40 degrees and is printed or etched on the clear or transparent cover 220 to provide a readily discernible indicator of the beam angle spread of the light that is emitted from the optic 206.

In one embodiment, a color temperature 230 of the light that is emitted from the optic 206 may be etched or printed on the transparent cover 220 of the optic 206 so that installers may easily determine the color temperature of an LED lamp by simply looking at the clear or transparent cover 220. In the particular embodiment shown in FIG. 8, the color temperature 230 (e.g., 3000K) is printed or etched on the clear or transparent cover 220 to provide a readily discernible indicator of the color temperature of the light that is emitted from the optic 206.

Figure 9:
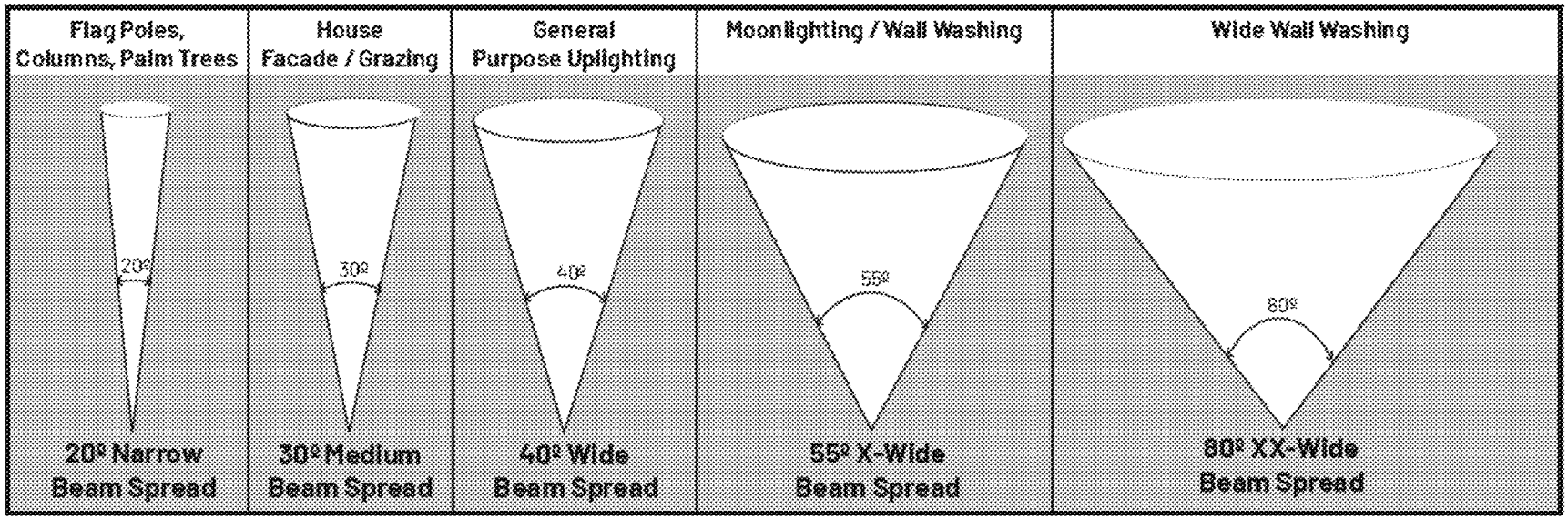
FIG. 9 is a chart that illustrates the different beam spread angles for optics of LED lamps of a landscape lighting system, in accordance with one embodiment of the present patent application.

Referring to FIG. 9, in one embodiment, the optics of the LED lamps 100A-100E (FIG. 1) may produce different beam angle spreads. In one embodiment, the different beam angle spreads may include, but not be limited to, 20 degrees (i.e., Narrow Beam Spread), 30 degrees (i.e., Medium Beam Spread), 40 degrees (i.e., Wide Beam Spread), 55 degrees (i.e., X-Wide Beam Spread), and 80 degrees (i.e., XX-Wide Beam Spread).

In one embodiment, different combinations of the LED lamps 100A-100E (FIG. 1) disclosed herein may be used for providing landscape lighting. The exact combination of how the LED lamps are used, and the locations of the LED lamps, may be varied to customize the landscape lighting system for use with a particular landscape.

Figure 10:
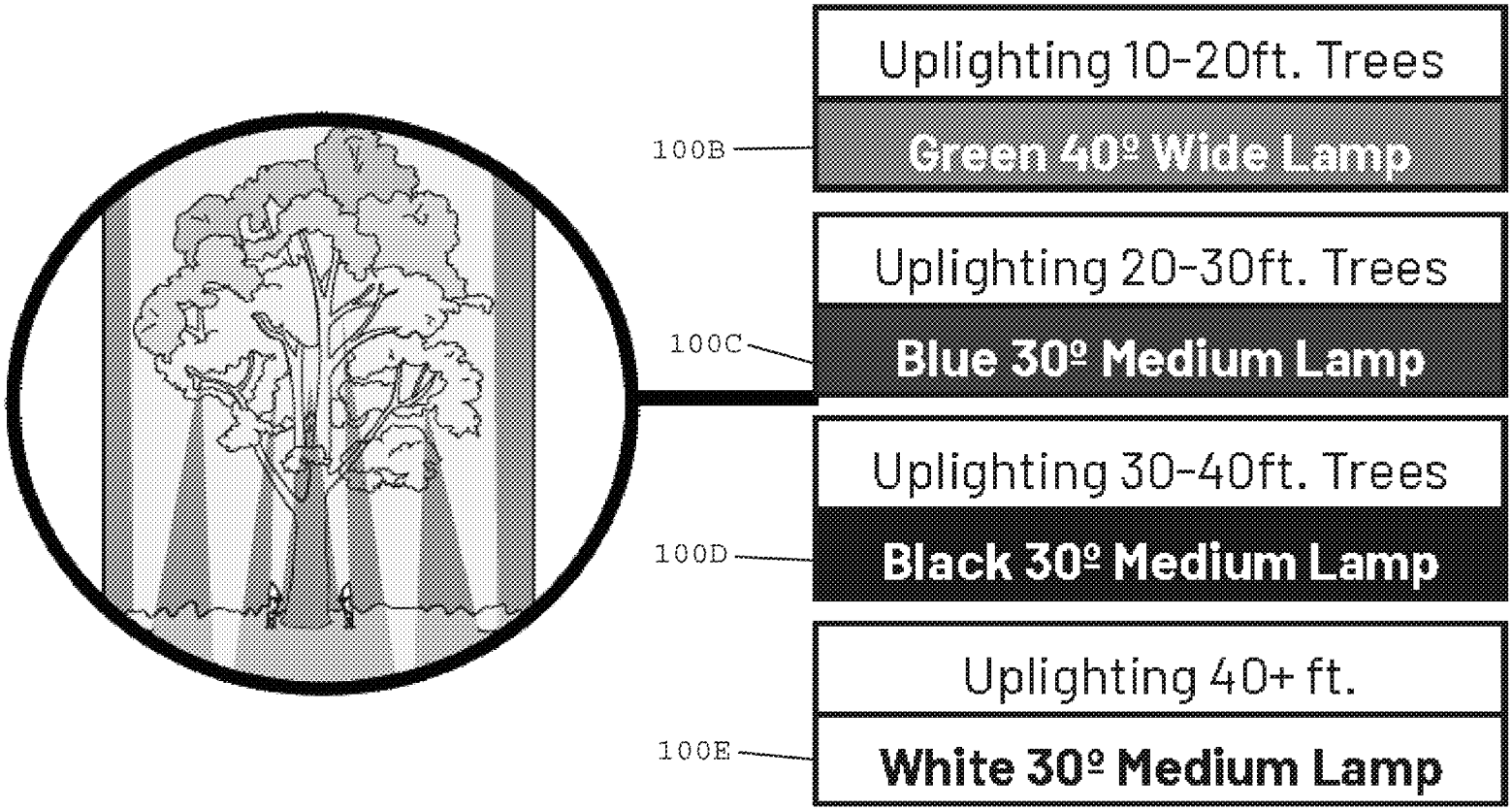
FIG. 10 is a schematic view of a first application of a landscape lighting system, in accordance with one embodiment of the present patent application.

Referring to FIG. 10, in one embodiment, a landscape lighting system may be used to provide uplighting for illuminating trees. The landscape lighting system may include a second LED lamp 100B (FIGS. 1 and 3) that emits light at light level #2 and at a beam spread angle of 40 degrees (i.e., Wide) for uplighting trees that are 10-20 feet tall; a third LED lamp 100C (FIGS. 1 and 4) that emits light at light level #3 and at a beam angle spread of 30 degrees (i.e., Medium) for uplighting trees that are 20-30 feet tall; a fourth LED lamp 100D (FIGS. 1 and 5) that emits light at light level #4 and at a beam angle spread of 30 degrees (i.e., Medium) for uplighting trees that are 30-40 feet tall; and a fifth LED lamp 100E (FIGS. 1 and 6) that emits light at light level #5 and at a beam angle spread of 30 degrees (i.e., Medium) for uplighting trees that are 40 feet tall and above.

Figure 11:
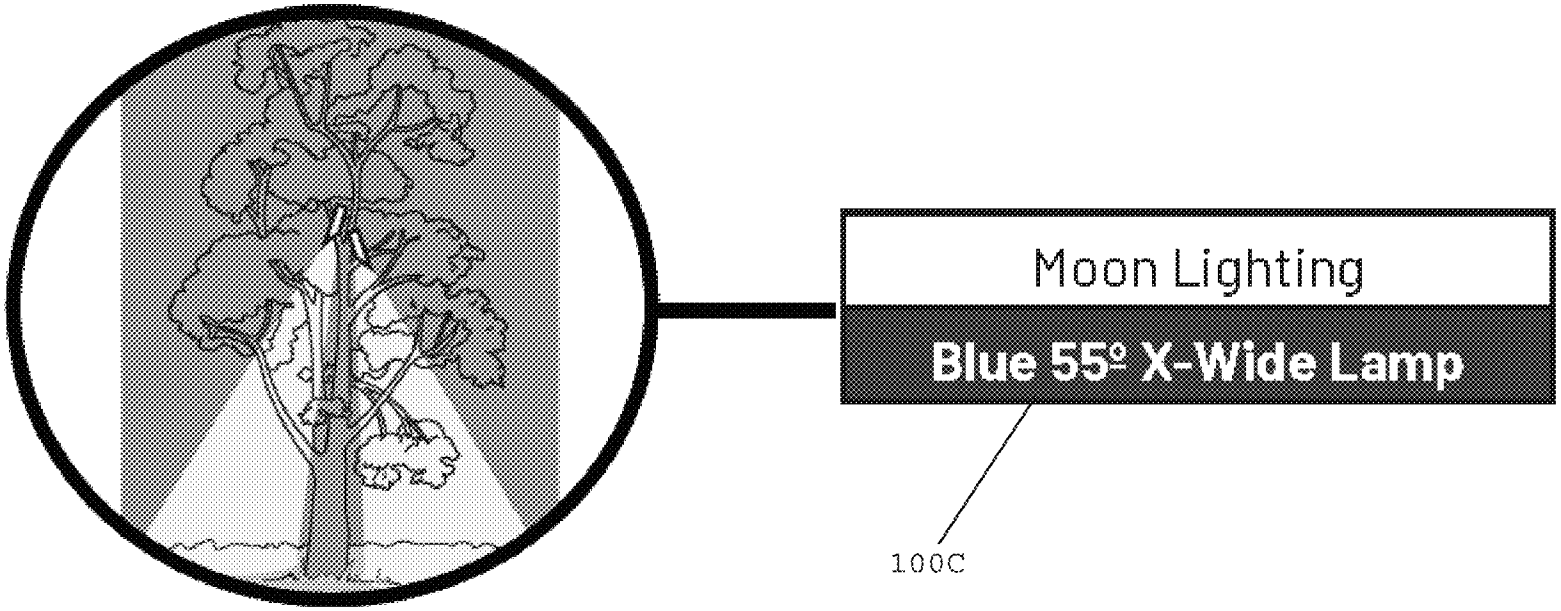
FIG. 11 is a schematic view of a second application of a landscape lighting system, in accordance with one embodiment of the present patent application.

Referring to FIG. 11, in one embodiment, a landscape lighting system may be used to provide moon lighting for a tree. The landscape lighting system may include a third LED lamp 100C (FIGS. 1 and 4) that emits light at light level #3 and at a beam angle spread of 55 degrees (i.e., X-Wide) for providing moon lighting for a tree.

Figure 12:
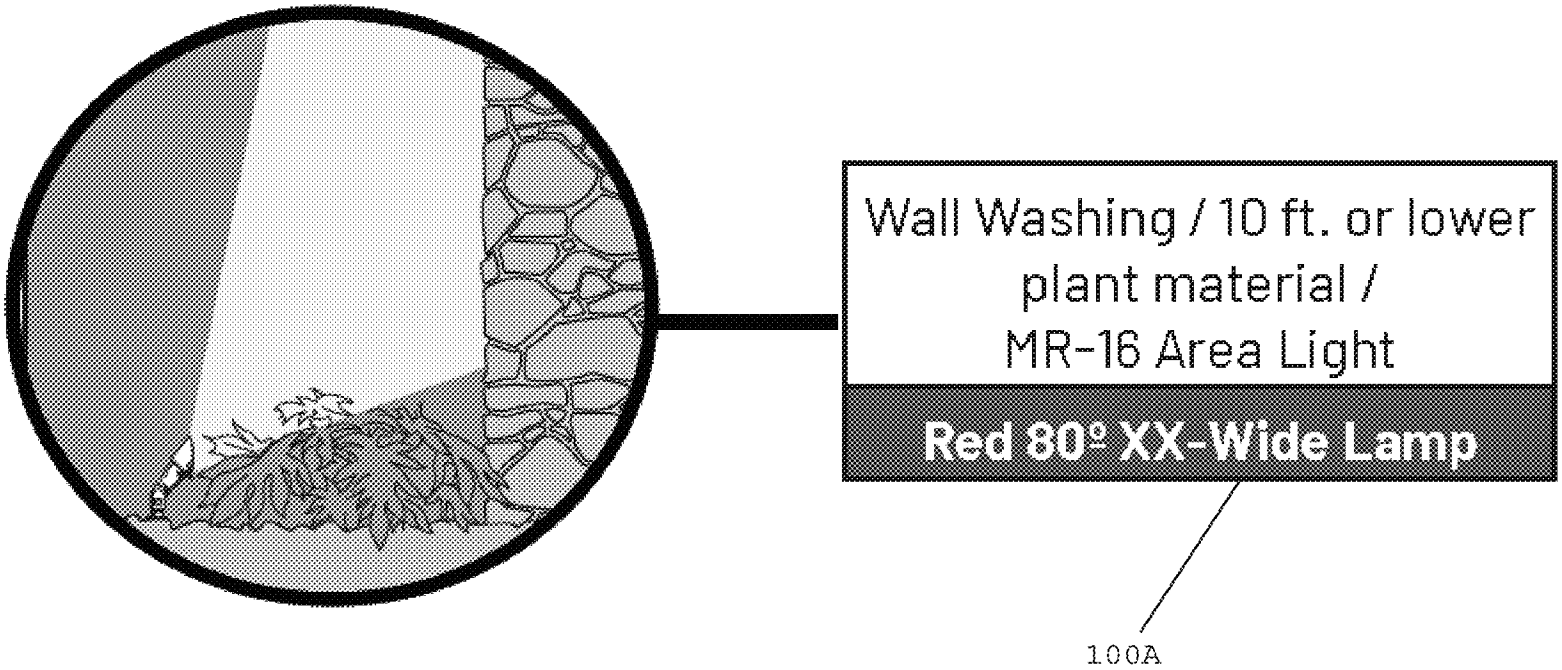
FIG. 12 is a schematic view of a third application of a landscape lighting system, in accordance with one embodiment of the present patent application.

Referring to FIG. 12, in one embodiment, a landscape lighting system may be used to provide wall washing lighting and/or to illuminate shorter plant material. In one embodiment, the landscape lighting system may include a first LED lamp 100A (FIGS. 1 and 2) that emits light at light level #1 and at a beam angle spread of 80 degrees (i.e., XX-Wide) for providing wall washing lighting.

Figure 13:
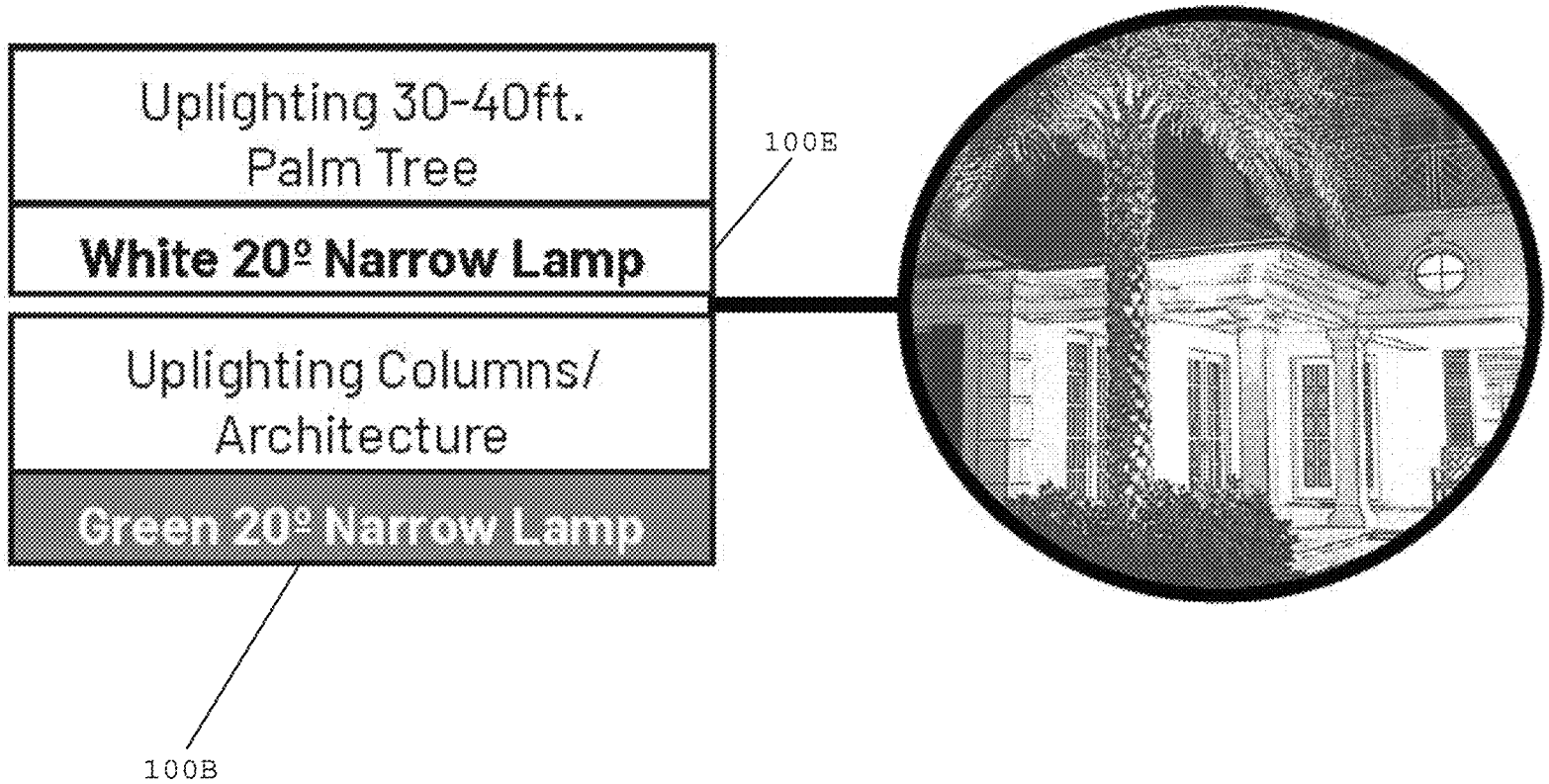
FIG. 13 is a schematic view of a fourth application of a landscape lighting system, in accordance with one embodiment of the present patent application.

Referring to FIG. 13, in one embodiment, a landscape lighting system may be used to provide uplighting for illuminating trees and columns, architecture. The landscape lighting system may include a fifth LED lamp 100E (FIGS. 1 and 6) that emits light at light level #5 and at a beam spread angle of 20 degrees (i.e., Narrow) for uplighting a palm tree; and a second LED lamp 100B (FIGS. 1 and 3) that emits light at light level #2 and at a beam angle spread of 20 degrees (i.e., Narrow) for uplighting columns/architecture.

Figure 14:
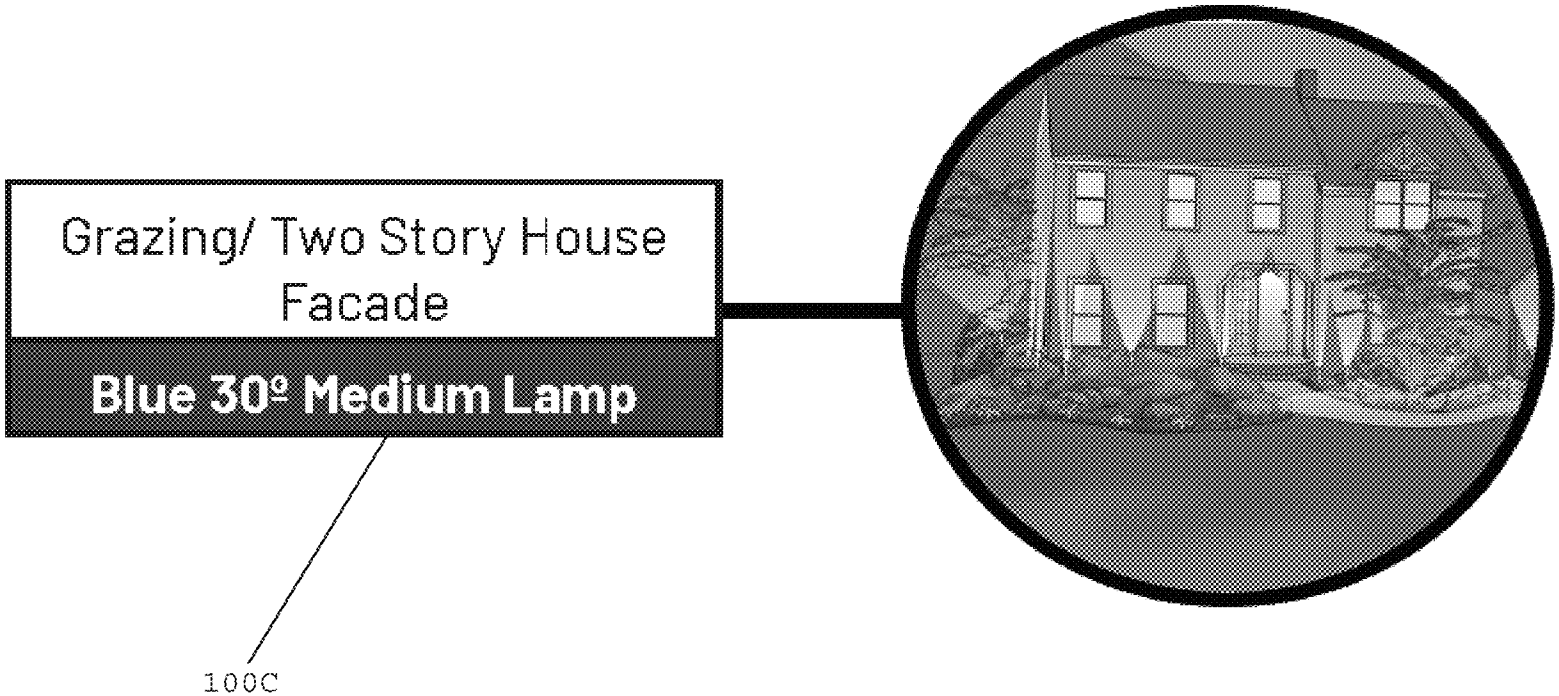
FIG. 14 is a schematic view of a fifth application of a landscape lighting system, in accordance with one embodiment of the present patent application.

Referring to FIG. 14, in one embodiment, a landscape lighting system may be used to provide grazing lighting for a house, such as the façade of a two story house. In one embodiment, the landscape lighting system may include a plurality of third LED lamps 100C (FIGS. 1 and 4) that emits light at light level #3 and at a beam angle spread of 30 degrees (i.e., Medium) for illuminating the façade of a two story house.

Figure 15:
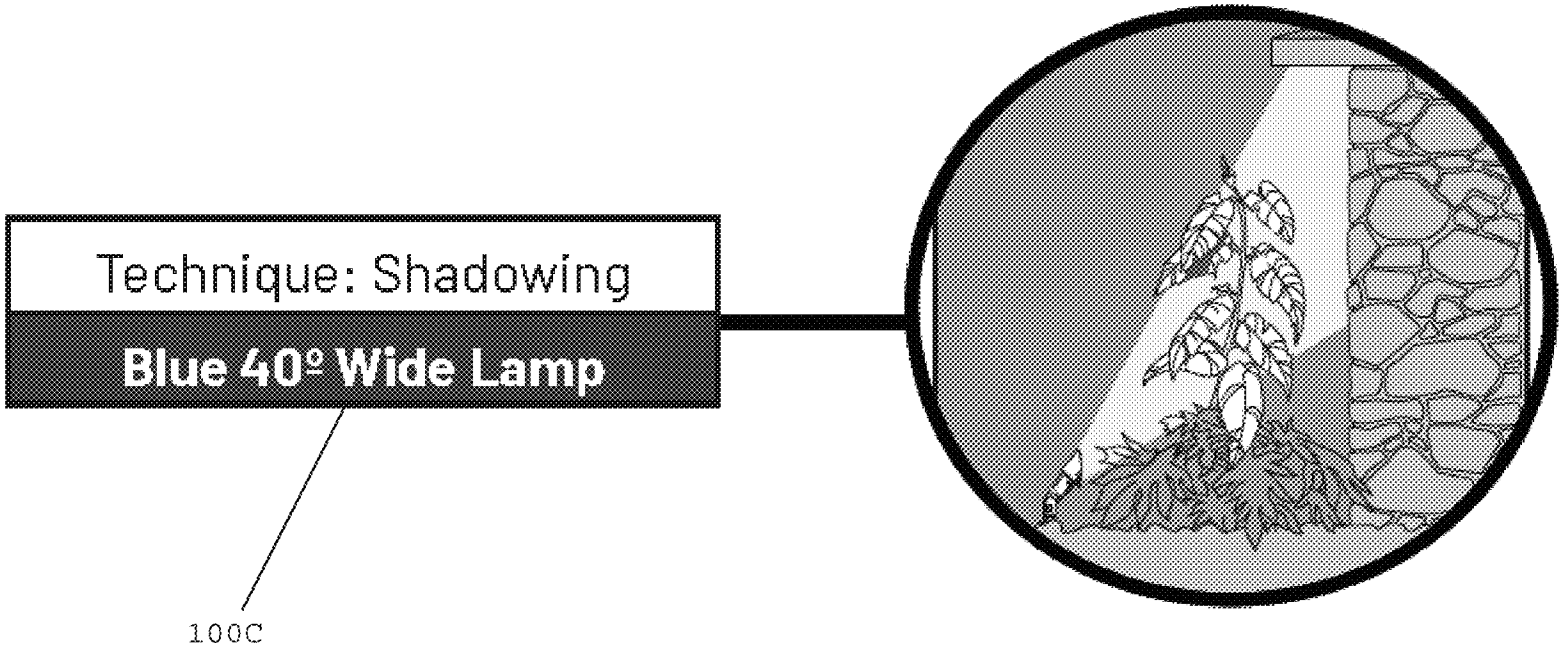
FIG. 15 is a schematic view of a sixth application of a landscape lighting system, in accordance with one embodiment of the present patent application.

Referring to FIG. 15, in one embodiment, a landscape lighting system may be used to provide shadowing light. In one embodiment, the landscape lighting system may include a third LED lamp 1000 (FIGS. 1 and 4) that emits light at light level #3 and at a beam angle spread of 40 degrees (i.e., Wide) for illuminating plants.

Figure 16:
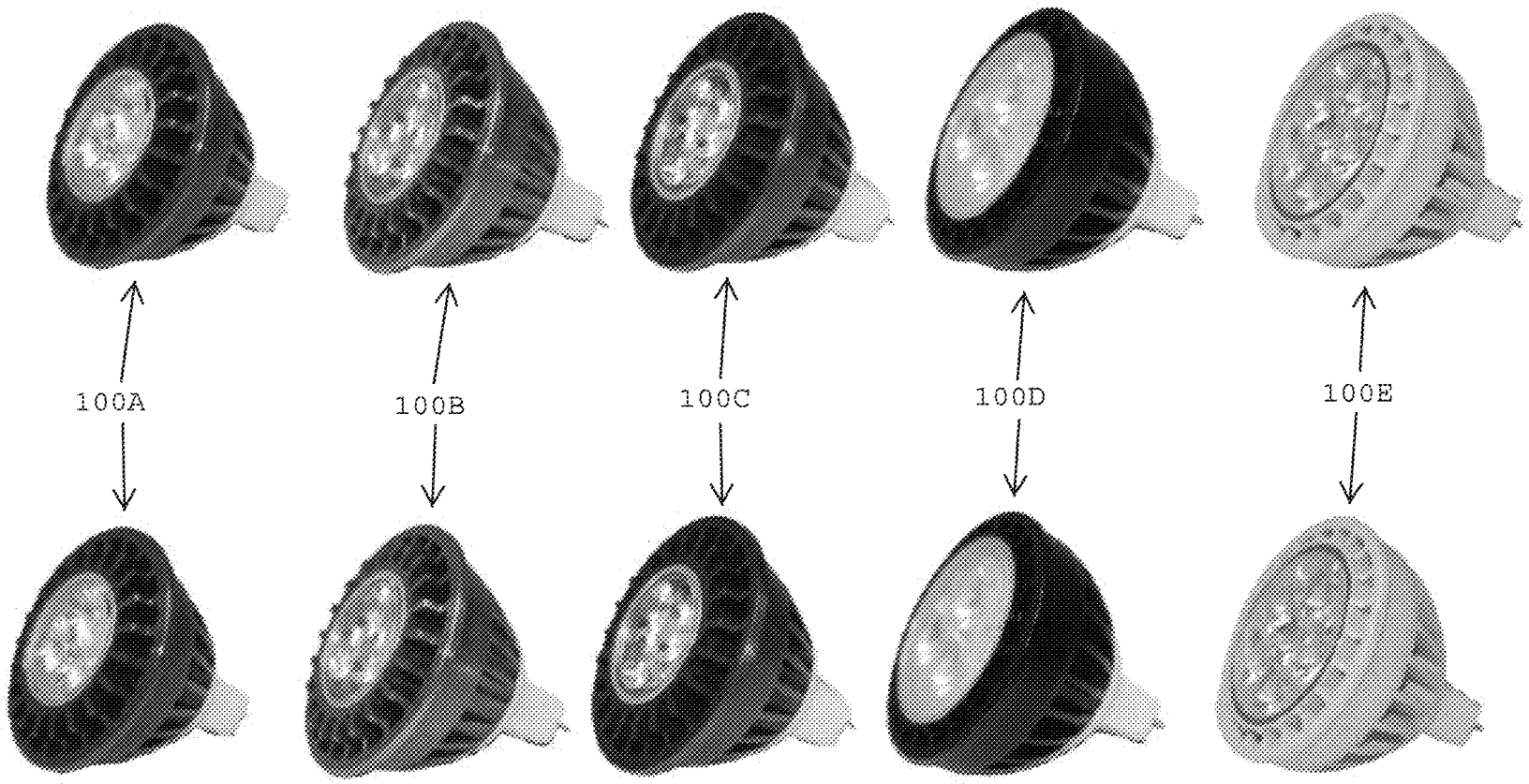
FIG. 16 is a landscape lighting kit including a pair of first LED lamps that emit light at a first lumen level, a pair of second LED lamps that emit light at a second lumen level, a pair of third LED lamps that emit light at a third lumen level, a pair of fourth LED lamps that emit light at a fourth lumen level, and a pair of fifth LED lamps that emit light at a fifth lumen level, in accordance with one embodiment of the present patent application.

In one embodiment, the LED lamps disclosed herein may be compiled together in landscape lighting kits having a plurality of LED lamps having different lumen levels and/or different beam spread angles, which enable landscape lighting installers to customize landscape lighting for use on different landscapes. Referring to FIG. 16, in one embodiment, a landscape lighting kit for providing landscape lighting for landscapes preferably includes a plurality of LED lamps 100A-100E. In one embodiment, a landscape lighting kit preferably includes two of the first LED lamps 100A (FIGS. 1 and 2), two of the second LED lamps 100B (FIGS. 1 and 3), two of the third LED lamps 100C (FIGS. 1 and 4), two of the fourth LED lamps 100D (FIGS. 1 and 5), and two of the fifth LED lamps 100E (FIGS. 1 and 6).

The present patent application may include one or more of the components or embodiments disclosed in U.S. Pat. No. 9,945,538, assigned to Mind Head LLC of Ridgewood, N.J., the disclosure of which is hereby incorporated by reference herein.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A landscape lighting system comprising:

a first LED lamp including a first lamp body and an optic having at least one LED for generating light;

a second LED lamp including a second lamp body and an optic having at least one LED for generating light;

said first lamp body having a first color for indicating a first lumen level for the light generated by said first LED lamp;

said second lamp body having a second color that is different than the first color for indicating a second lumen level for the light generated by said second LED lamp, wherein the second lumen level is different than the first lumen level;

wherein said optic of said first LED lamp has a transparent cover with a beam angle spread indicator provided on said transparent cover for indicating a beam angle spread for the light emitted from said first LED lamp.

2. The system as claimed in claim 1, wherein said optic of said second LED lamp has a transparent cover with a beam angle spread indicator provided on said transparent cover for indicating a beam angle spread for the light emitted from said second LED lamp.

3. The system as claimed in claim 1, wherein said first lamp body is red and said second lamp body is green.

4. The system as claimed in claim 1, further comprising:

a third LED lamp including a third lamp body and an optic having at least one LED for generating light, said third lamp body having a third color that is different than the first and second colors for indicating a third lumen level for the light generated by said third LED lamp, wherein the third lumen level is different than the first and second lumen levels.

5. The system as claimed in claim 4, further comprising:

a fourth LED lamp including a fourth lamp body and an optic having at least one LED for generating light, said fourth lamp body having a fourth color that is different than the first, second, and third colors for indicating a fourth lumen level for the light generated by said fourth LED lamp, wherein the fourth lumen level is different than the first, second, and third lumen levels.

6. The system as claimed in claim 5, wherein said third lamp body is blue and said fourth lamp body is black.

7. The system as claimed in claim 6, further comprising:

a fifth LED lamp including a fifth lamp body and an optic having at least one LED for generating light, said fifth lamp body having a fifth color that is different than the first, second, third, and fourth colors for indicating a fifth lumen level for the light generated by said fifth LED lamp, wherein the fifth lumen level is different than the first, second, third, and fourth lumen levels.

8. The system as claimed in claim 7, wherein said fifth lamp body is white.

9. A landscape lighting system comprising:

a first LED lamp including a first lamp body and an optic having at least one LED for generating light;

a second LED lamp including a second lamp body and an optic having at least one LED for generating light;

said first lamp body having a first color for indicating a first lumen level for the light generated by said first LED lamp;

said second lamp body having a second color that is different than the first color for indicating a second lumen level for the light generated by said second LED lamp, wherein the second lumen level is different than the first lumen level, wherein at least one of said optics has a transparent cover and a color temperature indicator provided on said transparent cover.

10. A landscape lighting system comprising:

a first LED lamp including a first lamp body and an optic having at least one LED for generating light, said first lamp body having a first color for indicating a first lumen level for the light generated by said first LED lamp;

a second LED lamp including a second lamp body and an optic having at least one LED for generating light, said second lamp body having a second color for indicating a second lumen level for the light generated by said second LED lamp;

a third LED lamp including a third lamp body and an optic having at least one LED for generating light, said third lamp body having a third color for indicating a third lumen level for the light generated by said third LED lamp;

a fourth LED lamp including a fourth lamp body and an optic having at least one LED for generating light, said fourth lamp body having a fourth color for indicating a fourth lumen level for the light generated by said fourth LED lamp; and a fifth LED lamp including a fifth lamp body and an optic having at least one LED for generating light, said fifth lamp body having a fifth color for indicating a fifth lumen level for the light generated by said fifth LED lamp;

wherein said respective first, second, third, fourth and fifth lumen levels have lumen level ranges that are different from one another;

wherein said first lumen level has a lumen level range of about 74-106 lumens, said second lumen level has a lumen level range of about 128-193 lumens, said third lumen level has a lumen level range of about 199-305 lumens, said fourth lumen level has a lumen level range of about 175-421 lumens, and said fifth lumen level has a lumen level range of about 213-575 lumens.

11. The system as claimed in claim 10, wherein said respective first, second, third, fourth and fifth colors are different from one another.

12. The system as claimed in claim 11, wherein said first color is red, said second color is green, said third color is blue, said fourth color is black, and said fifth color is white.

13. The system as claimed in claim 10, wherein at least one of said optics of said LED lamps has a transparent cover and a beam angle spread indicator provided on said transparent cover.

14. The system as claimed in claim 10, wherein at least one of said optics of said LED lamps has a transparent cover and a color temperature indicator provided on said transparent cover.

15. The system as claimed in claim 10, wherein said system comprises a kit including at least two of said first LED lamps, at least two of said second LED lamps, at least two of said third LED lamps, at least two of said fourth LED lamps, and at least two of said fifth LED lamps.

16. A landscape lighting system comprising:

a first LED lamp including a first lamp body having a first color for indicating a first lumen level for light generated by said first LED lamp and an optic having at least one LED for generating the light that is emitted from said first LED lamp, wherein said optic of said first LED lamp has a transparent cover with a beam angle spread indicator provided on said transparent cover for indicating a beam angle spread for the light that is emitted from said first LED lamp;

a second LED lamp including a second lamp body having a second color that is different than the first color for indicating a second lumen level for light generated by said second LED lamp and an optic having at least one LED for generating the light that is emitted from said second LED lamp, wherein said optic of said second LED lamp has a transparent cover with a beam angle spread indicator provided on said transparent cover for indicating a beam angle spread for the light that is emitted from said second LED lamp, and wherein the second lumen level of the light that is emitted from said second LED lamp is different than the first lumen level of the light that is emitted from said first LED lamp.

17. The system as claimed in claim 16, wherein at least one optic of said LED lamps has a transparent cover and a color temperature indicator provided on said transparent cover.

* * * * *